United States Patent [19]

Speck

[11] Patent Number: 4,760,870

[45] Date of Patent: Aug. 2, 1988

[54] AUTOMATIC DADO AND SCORING MACHINE

[76] Inventor: Dwight L. Speck, 8130 Havens Corners Rd., Blacklick, Ohio 43004

[21] Appl. No.: 21,980

[22] Filed: Mar. 5, 1987

[51] Int. Cl.[4] ..... B27C 9/00

[52] U.S. Cl. ..... 144/3 R; 144/133 R; 144/136 R; 83/875

[58] Field of Search ..... 144/3 R, 133 R, 136 R; 83/863, 864, 865, 875, 878

[56] References Cited

U.S. PATENT DOCUMENTS

| | | | |
|---|---|---|---|
| 2,290,394 | 2/1941 | Vanderveld | 144/133 R |
| 2,951,517 | 9/1960 | Webb et al. | 144/136 R |
| 2,968,326 | 1/1961 | Myers | 144/136 R |
| 3,036,605 | 5/1962 | Joa | 144/133 R |
| 3,288,181 | 11/1966 | Fellman | 144/3 R |
| 3,421,556 | 1/1969 | Clifford | 144/3 R |
| 3,744,540 | 7/1973 | Wirch | 144/133 R |
| 3,838,723 | 10/1974 | Sandberg | 144/133 R |
| 4,058,150 | 11/1977 | Pennington | 144/136 R |
| 4,112,986 | 9/1978 | Strange | 144/133 R |
| 4,174,745 | 11/1979 | Benuzzi | 144/3 R |

*Primary Examiner*—W. Donald Bray
*Attorney, Agent, or Firm*—Robert B. Watkins

[57] ABSTRACT

A machine for performing dados, grooves, mortises, etc., of controlled depth in cabinet component parts and the like. Consisting in part of a main frame with a plurality of elongated support members of equal length. Having incorporated a plurality of tooling mounted to said frame, consisting in part, a plurality of scoring blades which aid a plurality of cutters in removal of material in a predetermined groove. An automatic revolving cylindrical material transfer apparatus, being of geometric shapes, and effectively advancing a work piece underneath said scoring blades and said cutters, and holding said work piece firmly to work surface and against a guide. The operating sequences herein are preferable but not necessarily limited to automatic control.

3 Claims, 5 Drawing Sheets

AUTOMATIC DADO AND SCORING MACHINE

TECHNICAL FIELD

This invention relates to dado machines, particulary to dado machines having capabilities of automatic in-feed and out-feed, in combination with automatic scoring capabilities.

BACKGROUND ART

The cabinet making industry basically consists of two distinct manufacturing procedures.

One such procedure is termed in the industry as "factory cabinets". This means cabinets being produced at a large volume, with the use of high speed computerized machinery, and employing unskilled labor.

Because of market demands, especially in the housing industry, factory cabinets are produced with very little attention to quality. Particularly joint construction, where in some cases joint making is avoided altogether.

Whereas a market for economical factory cabinetry exists, there also exists a market for fine quality custom built cabinetry. This being the second procedure of cabinet manufacturing.

Custom cabinet manufacturing involves a complete design by an architect and hand crafting by skilled artisan cabinetmakers. The reasons architects or owners would prefer custom cabinetry over "factory cabinets" are specialized work functions, aesthetics, marketing needs, unusual space restrictions, and durability.

To produce cabinetry of this stature the upmost painstaking procedures must be followed. All cabinetry of high quality are constructed with the use of dados. Precision cabinet making is wholly dependent upon the preciseness of the dado.

Dados being grooves in the cabinet end panels to receive a bottom or a back. Another place where dadoes may occur is in drawer structure. Yet another place where dados may occur is to recess shelf standard. Shelf standard being a vertical member with horizontal slots equally spaced, as to receive seats for shelves to rest on.

To date most all custom cabinet shops make dados by the use of a table saw. This has a multitude of drawbacks. One being that the table saw is pre-occupied with making dados, stopping production of other cutting operations. Another one being that the dado is cut from the bottom side of the work piece, allowing inaccurate dados to be made. Yet another drawback being that the operator cannot see the operation taking place. Still another drawback is on cross grain material of melamines, the prior art procedure of dadoing leaves the groove (dado) chipped and splintered.

Generally speaking, most all custom cabinet shops are of very small stature, by volume and number of employees. Therefore it would be ludicrous for a custom cabinet shop to make a large capital investment in high speed equipment. Such an example is U.S. Pat. No. 4,112,986, using routers to make dados. This equipment would not suffice in a custom cabinet shop. Not only is the capital investment beyond most custom shops' means, a major drawback is that you cannot cut a perfect dado going cross grain or through melamine. Router bits used on malamine and particularly on cross grain woods tend to fray and splinter the work piece making dado grooves in general unsightly and inaccurate. Also the dado width is totally dependent upon the diameter of the router bit. After the router bit is sharpened, its diameter is smaller. Therefore inadequate for the required width of the dado. Router bits therefore have to be discarded and replaced with new. The extraordinary cost of carbide and diamond tooling can make this an expensive operation.

We could also look at U.S. Pat. No. 3,036,605. Here we have some of the same drawbacks. One being the chipping and splintering of the work piece. Yet another being an enormous amount of mechanically moving parts. The more moving parts a machine has, the more change of a malfunction.

In essence: Without the means of scoring the work piece before making the primary dado, neither a router bit, nor a circular rotating blade will make a clean, precise dado.

The object of the present invention herein described and illustrated, is to provide an economical means of cutting precision dados into sheet materials.

Another object of the present invention is to provide protection to the operator, meaning the configuration of the guard.

Another object of the present invention is to provide directional flow of work piece, meaning the configuration of said guard, has a diagonal slant at the in-feed side only.

Yet another object of the present invention is to provide a controlled dado depth, meaning the distance between the work surface and cutters.

Still another object of the present invention is to provide an automatic work piece transfer system, means in-feed and out-feed by tapered rotating feed rollers.

Yet another object of the present invention is to provide an automatic in-feed and out-feed system that applies constant pressure, means to hold down work piece to work surface.

Still another object of the present invention is to provide an automatic in-feed and out-feed system that applies constant pressure of the forementioned work piece, and against a guide, by means of tapered geometric shape of said feed rollers.

Yet another object of the present invention is to provide reliefs in the work piece, by the use of scoring blades.

Still another object of the present invention is to provide simplicity in mechanics, means adjustability of a plurality of tooling.

Yet another object of the present invention is to provide said mechanics with easy replacement, means readily accessability of replacement parts.

Other objects and advantages of the present invention will become apparent to those skilled in the art as further described hereinafter.

The present invention will be more understood with reference to the following accompanying description and accompanying detailed drawings, in which:

DETAILED DESCRIPTION

Figure 1:
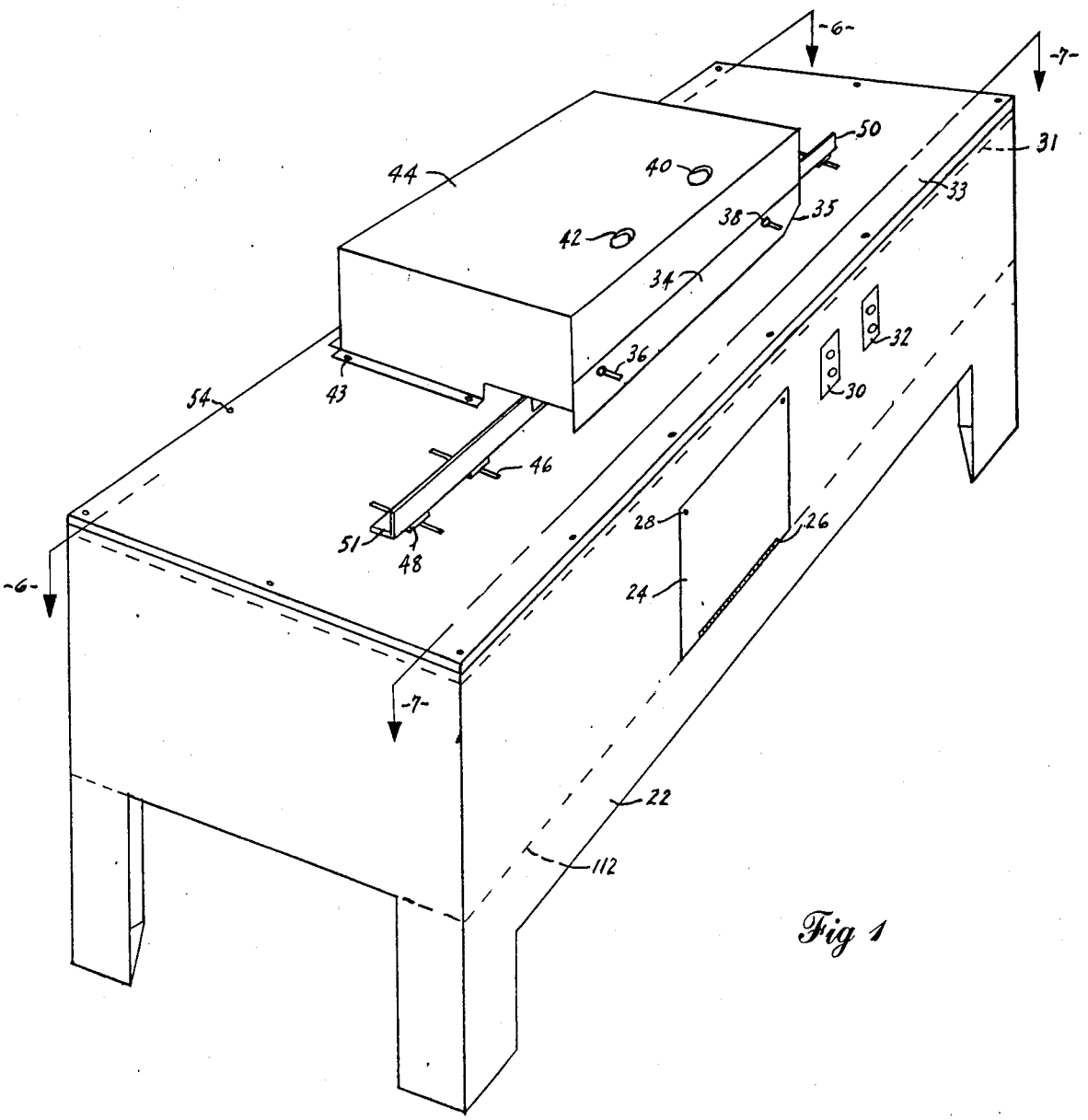
FIG. 1 is a perspective view of one embodiment of the invention.
Figure 6:
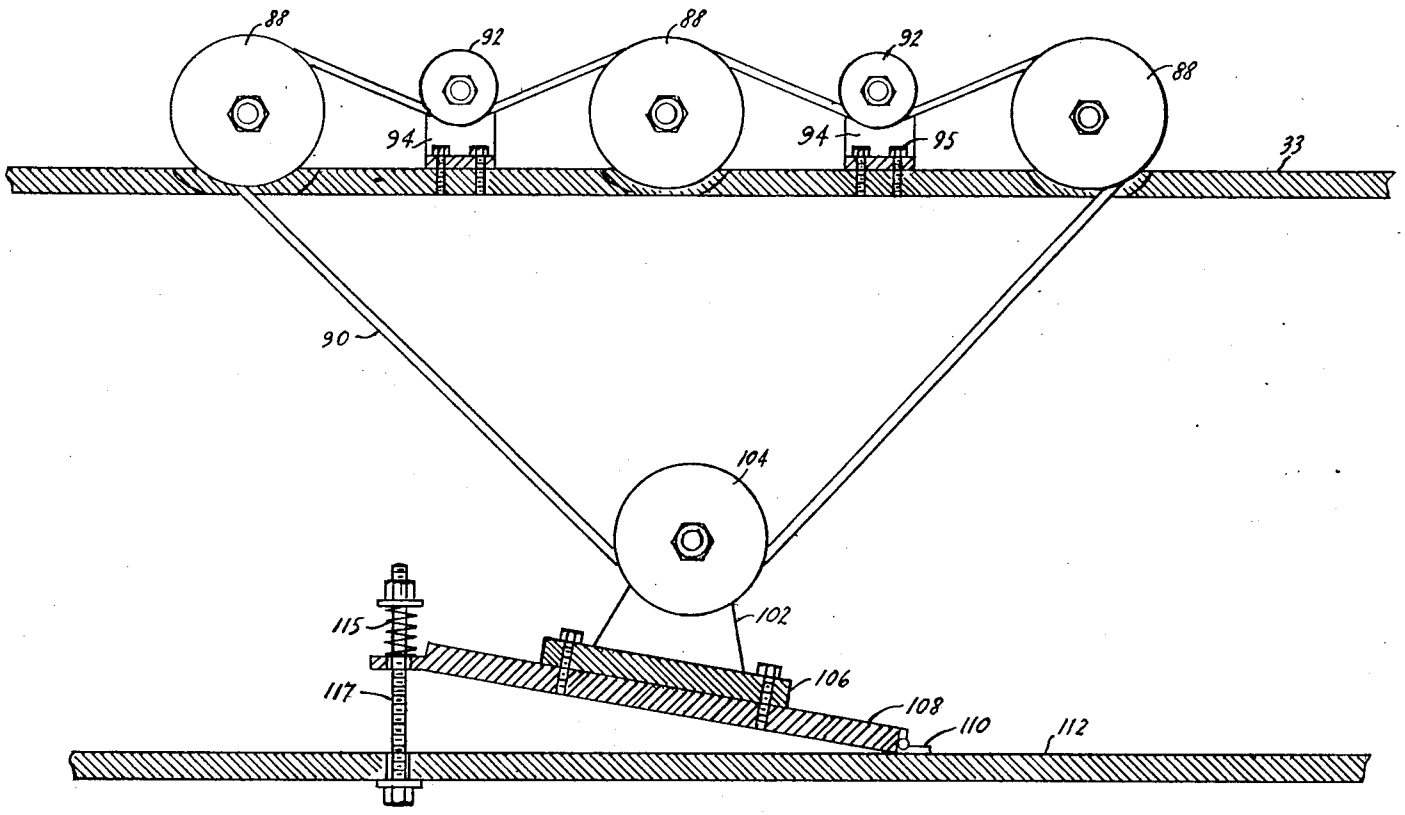
FIG. 6 is a cross section taken along the line 6—6 of FIG. 1.
Figure 7:
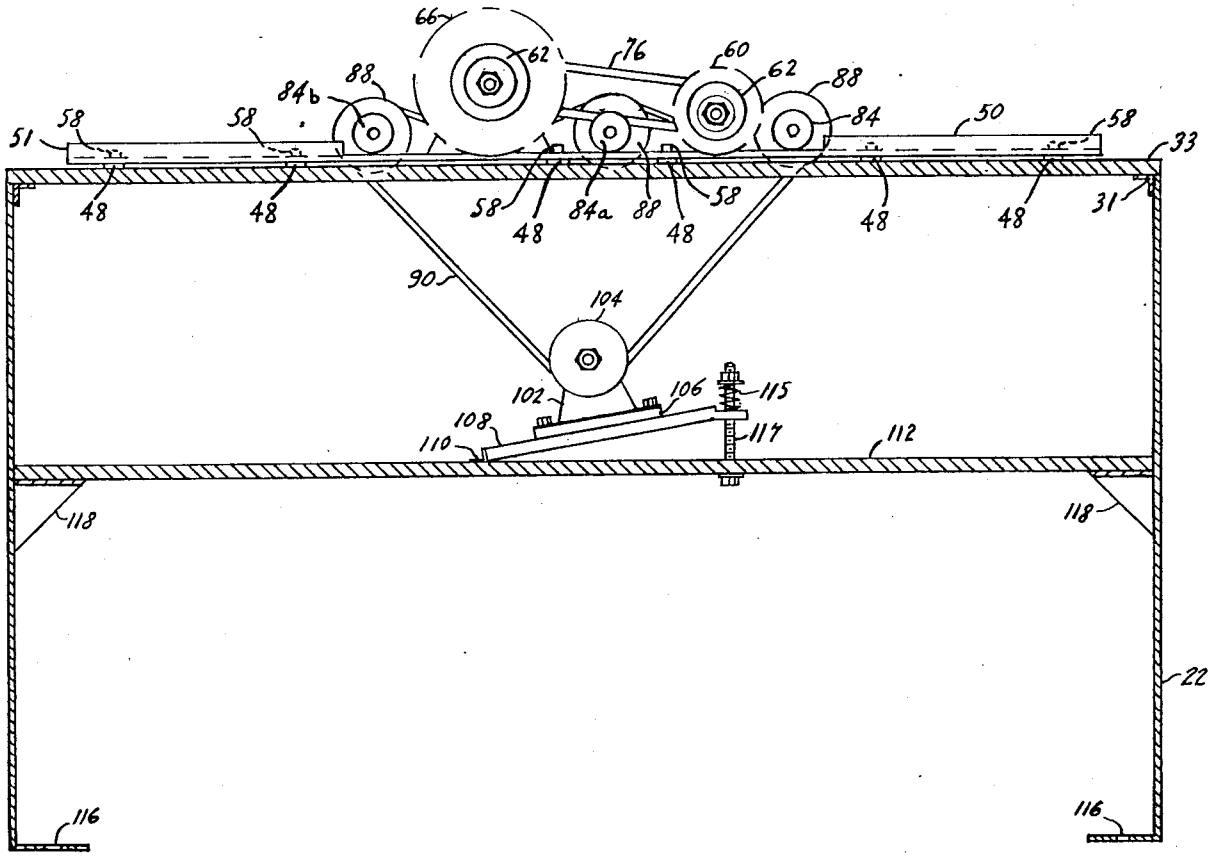
FIG. 7 is a cross section taken along eh line 7—7 of of FIG. 1.
Figure 10:
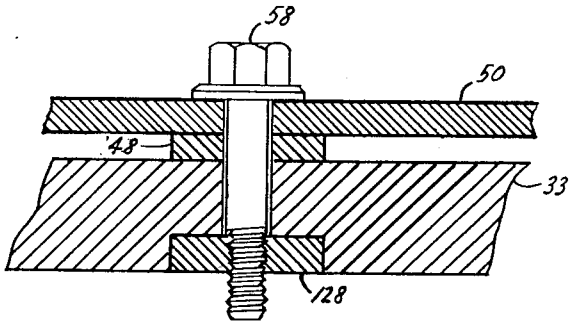
FIG. 10 is a fragmentary section through the machine at the guide illustrating adjustability of same.

FIG. 1 is a perspective view illustrating the machine being supported by a main frame 22 having access doors 24 front and rear (rear not shown) secured to main frame by hinge 26 and fasteners 28. Primary cutter 66 and scoring tooling 60 (best seen in FIG. 2) are located under guard 44 and are supported by work surface 33. Said tooling located under said guard is controlled by switch 30. Switch 32 controls motor 102 (FIGS. 6 and 7), being an automatic feed roller apparatus which is mounted to platform 112 (FIGS. 6 and 7). The forementioned work surface 33 is secured to the main frame 22 by cap screws 54, screwed to angle 31 (FIG. 7). Secondary guard 34 having diagonally slotted holes 36 is attached to said guard 44 by shoulder screws 38. Guide 50 and 51 (one continuous guide, but identified as such for illustrating infeed/outfeed operation) is adjusted by sliding in slots 46 (FIGS. 2 and 10) and secured to work surface 33 by fastener 58 (FIGS. 2 and 10), and same secured by square nut 128 (FIG. 10) thereby securing spacer 48. Said spacer allows excess dust to go under guide 50 and 51, which is not exhausted by vacuum port holes 40 and 42.

Figure 3:
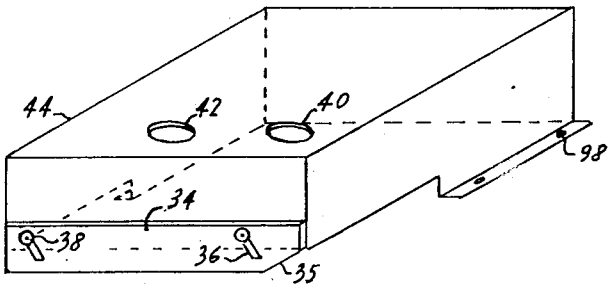
FIG. 3 is a perspective view of the forementioned guard.
Figure 2:
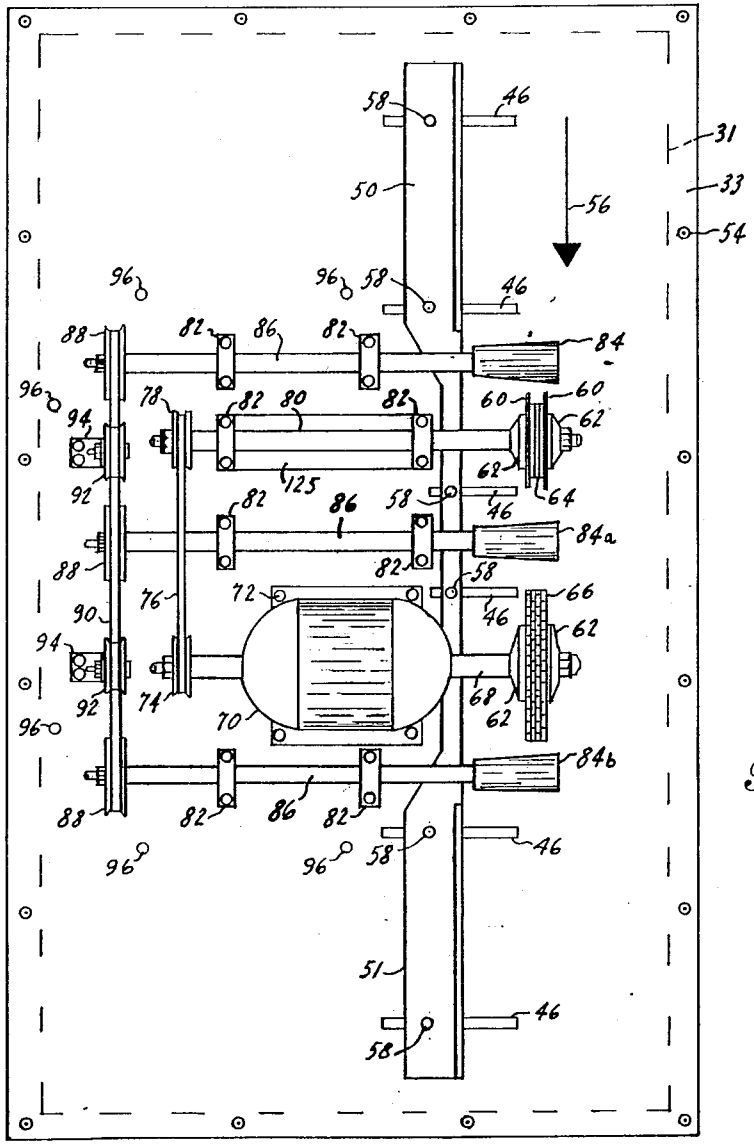
FIG. 2 is a plan view with guard removed for clarity.

FIG. 2 shows tooling in a plan view with guard 44 (FIGS. 1 and 3) which is normally secured to work surface 33 by threaded bolts going through holes 98 and screwed into tapped holes 96, but in this view removed for clarity.

Scoring blades 60 are adjusted in width by use of spacers 64, and should be of equal width as primary cutters 66. Said primary cutter 66 is made up of individual blades whereby removing or adding blades, width of said primary cutter can be made. Both scoring blades 60 and primary cutter 66 are held rigid by use of stabilizer plates 62.

Figure 8:
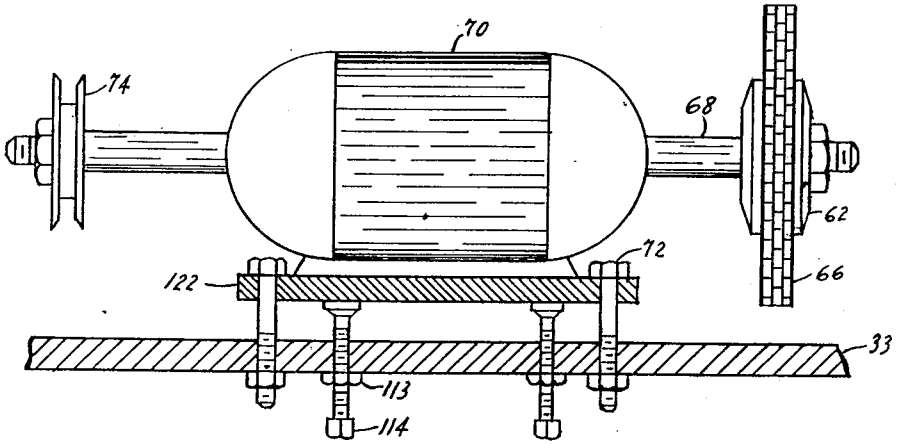
FIG. 8 is a fragmentary section through the machine at the primary blade drive motor illustrating the vertical adjustability.

FIG. 8 best illustrates how depth adjustment for primary cutter 66 is achieved, by loosening bolt 72 which secures motor base 122 to work surface 33. Whereby adjusting self leveling jackscrews 114 by loosening lock nut 115 the proper distance between primary cutter 66 and work surface 33 is obtained.

Figure 9:
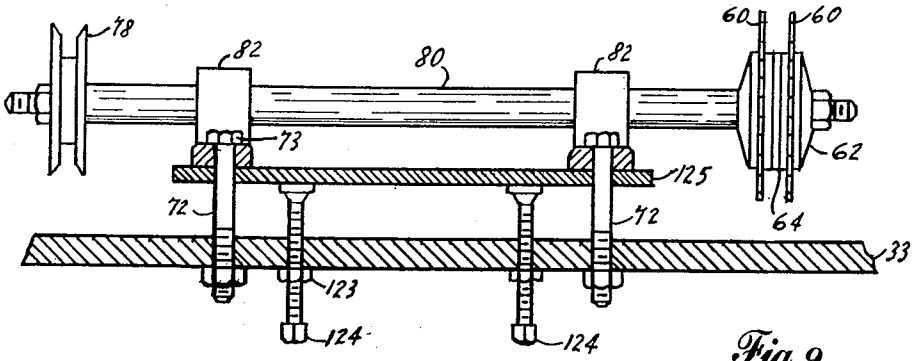
FIG. 9 is a fragmentary section through the machine at the scoring blade mandrel illustrating the vertical adjustability.

FIG. 9 best illustrates how the depth adjustment for scoring blades 60 can be achieved, by loosening bolts 73 which attach pillow block bearing 82 to mounting plate 125 and secure same to work surface 33. By loosening lock nut 123 self leveling jackscrews 124 can be turned to either raise or lower mounting plate 125 which in turn raises or lowers shaft 80 (also referred to as a mandrel) which extends through pillow block bearings 82 and thereby adjusts proper distance between attached scoring blades 60, and work surface 33.

Figure 5:
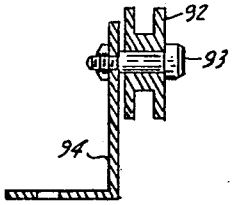
FIG. 5 is a fragmentation of idler pulley.

FIGS. 2 and 8 showing motor 70 having a double ended drive shaft 68 provides rotational energy to primary cutter 66 whereas said rotation power scoring blades 60 by belt 76 which is connected to keyed pulleys 74 and 78, thereby transferring rotational energy to shaft 80 which rotates scoring blades 60. Although not shown but if necessary, tension to belt 76 can be applied by use of idler pulley 92 (FIG. 5) placed between motor 70 and shaft 80 and, secured to work surface 33 by bracket 94 and allowing belt 76 to go under said pulley in same manner as illustrated in FIG. 6.

Figure 4:
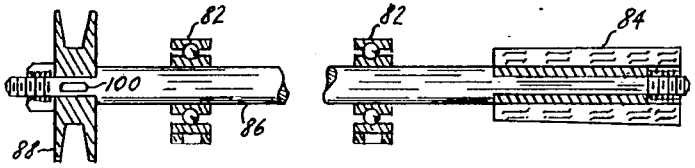
FIG. 4 is a fragmentation of feed rollers.

FIG. 2 showing feed rollers 84, 84*a*, and 84*b* are best illustrated in a fragmentation on FIG. 4, where said rollers consisting of pillow block bearings 82 which are bolted to work surface 33. Said bearings support threaded shaft 86 having attached forementioned feed rollers, and pulley 88 held by key 10 on to shaft 86, (hereinafter all pulleys are assumed keyed, with the exception of idler pulleys 92 FIG. 5).

FIGS. 2 and 7 while showing drive train for feed rollers 84, 84*a*, and 84*b* is best illustrated by FIG. 6 taken through lines 6—6 of FIG. 1. Pulleys 88 are driven by drive belt 90 with idler pulleys 92 being fastened to bracket 94 and secured to work surface 33 by bolts 95, said idler pulleys insure said drive belt has positive contact with pulleys 88, thereby rotating formentioned feed rollers by energy supplied by feed roller drive motor 102 activated by switch 32 (FIG. 1), whereby said motor rotates pulley 104. To insure proper tension on drive belt 90 motor base 106 is secured to platform 108 by hinge 110 that is secured to intermediate support 112, said support is fastened to main frame 22 by use of gusses 118. Proper tension on said drive belt is achieved by adjusting bolt 114. Tension spring 115 is meant to relieve access vibration which is not absorbed by bolting main frame 22 to the factory floor by use of bolt holes 116.

FIG. 1 will show how work piece is placed on work surface 33 in the direction of flow arrow 56 (FIG. 2) by placing said work piece against fence 50 and advancing to secondary guard 34, thereby applying pressure said guard begins to lift by way of diagonally slotted holes 36 attached to guard 44 by shoulder bolts 38. Secondary guard 34 should also prevent wrong directional insertion of work piece by its configuration with diagonal slant 35 being on in feed side only. While the primary purpose of feed rollers 84, 84*a* and 84*b* (FIGS. 2, 4, and 7) is to automatically pull the work piece under cutters 60 and 66 (FIGS. 1, 8, and 9) other advantages are made available, such as holding the work piece firmly to work surface 33. Possible prevention of anti-kick backby tension on pulleys 88 (FIGS. 6 and 7) applied by drive belt 90 and idler pulleys 88 (FIG. 6). Theoretically the geometrical tapered or cone shaped rubber rollers 84, 84*a*, and 84*b*, (FIGS. 2 and 4) will constantly pull the work piece against guide 50 and 51, disallowing said work piece to "drift" away from primary cutter 66 (FIGS. 2 and 8) and scoring blades 60 (FIGS. 2 and 9). Said feed rollers are secured by screwing onto threaded shaft 86 (FIG. 2) allowing feed rollers to be replaced due to wear or if different shapes or sizes are desired.

FIG. 7 is a sectional view taken on lines 7—7 of FIG. 1 giving a better view due to guard 44 (FIG. 3) being removed. As the work piece is further advanced on work surface 33 it begins to be automatically advanced by feed roller 84. Said feed roller pulls work piece underneath scoring blades 60 making scores on work piece the same width as primary cutter 66. As work piece advances, feeder roller 84*a* assists in advancement of work piece. Said work piece is now entered under primary cutter 66, making the final pre-determined cut. A work piece leaves feed roller 84, feed roller 84*b* takes over in assisting feed roller 84*a*. Feed roller 84*b* will continue to process work piece until said work piece is clear of primary cutter 66 and rest alone against guide 51, completing the operation.

Thus, now the invention having been described in full, combined with use of illustrations, has been made clear and the description while containing many specificities, the reader should not construe these as limitations on the scope of the invention, but merely as exemplifications of preferred embodiments thereof. It will become immediately obvious to those skilled in the art that many other possible variations are within its scope.

I claim:

1. Apparatus for cutting dados in sheet materials, and comprising:

a. a flat work surface;

b. sheet material guide means mounted on said flat work surface;

c. a pair of rotatable and adjustable spaced-apart circular saw blades mounted in fixed location relative to said guide means;

d. a rotatable and adjustable primary dado cutter means mounted in aligned relation relative to said circular saw blades and in fixed location relative to said guide means;

e. adjustable feed roller means mounted in fixed relation relative to said guide means; and f. drive means rotating said spaced-apart circular saw blades, said primary cutter means, and said feed roller means in the same rotational direction, said circular saw blades contacting sheet material prior to said dado cutter means as the sheet material is fed in one direction along said guide means.

2. The apparatus defined by claim 1 wherein said feed roller means are resilient, externally tapered driven rollers, said tapered feed roller means urging the sheet material against said guide means as the sheet material is being fed in the direction of from said circular saw blades toward said primary dado cutter means.

3. The apparatus defined by claim 1 further comprising guard means, said guard means preventing sheet material from being fed along said guide means except in the direction of from said circular saw blades toward said primary dado cutter means.

* * * * *